US008454110B2

(12) United States Patent
Ochiai et al.

(10) Patent No.: US 8,454,110 B2
(45) Date of Patent: Jun. 4, 2013

(54) INK JET PRINTING SYSTEM AND INK JET PRINTING METHOD

(75) Inventors: Takashi Ochiai, Machida (JP); Hitoshi Tsuboi, Kawasaki (JP); Satoshi Wada, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/167,662

(22) Filed: Jul. 3, 2008

(65) Prior Publication Data

US 2009/0015611 A1 Jan. 15, 2009

(30) Foreign Application Priority Data

Jul. 6, 2007 (JP) ..... 2007-178668

(51) Int. Cl.
*B41J 29/38* (2006.01)
*B41J 2/15* (2006.01)

(52) U.S. Cl.
USPC ..... 347/12; 347/9; 347/40

(58) Field of Classification Search
USPC ..... 347/9, 12, 14, 40, 41
See application file for complete search history.

(56) References Cited

U.S. PATENT DOCUMENTS 6,312,099 B1 * 11/2001 Hawkins et al. ..... 347/42
6,846,064 B2 1/2005 Yamane
7,216,953 B2 * 5/2007 Wada et al. ..... 347/19
7,237,871 B2 7/2007 Yamaguchi et al.
7,278,700 B2 10/2007 Yamaguchi et al.
7,380,896 B2 6/2008 Wada
7,399,049 B2 7/2008 Jahana et al.
7,540,578 B2 * 6/2009 Suzuki et al. ..... 347/12
2005/0219279 A1 10/2005 Goto et al.
2007/0120883 A1 5/2007 Tsuboi
2007/0165068 A1 7/2007 Tsuboi
2007/0291062 A1 12/2007 Noguchi et al.
2008/0049057 A1 2/2008 Ochiai et al.
2008/0136855 A1 6/2008 Ochiai et al.
2008/0143767 A1 6/2008 Ochiai et al.
2008/0252673 A1 10/2008 Wada et al.

FOREIGN PATENT DOCUMENTS

JP 5-57965 3/1993
JP 2003-305853 10/2003
JP 2006-334994 A 12/2006
JP 2007-015180 A 1/2007
JP 2007-030503 A 2/2007

* cited by examiner

*Primary Examiner* — Jannelle M Lebron
(74) *Attorney, Agent, or Firm* — Fitzpatrick, Cella, Harper & Scinto

(57) ABSTRACT

An image data signal value conversion is performed such that the volume of ink applied to image areas on a print medium to be printed by the overlapping portions of the printing element substrates is smaller than that applied to image areas on the print medium to be printed by portions other than the overlapping portions. Alternatively, the image data signal value conversion is performed such that the volume of ink applied to overlapping areas on the print medium to be printed by two consecutive printing main scans is smaller than that applied to areas other than the overlapping areas. For this reason, even when forming photographic images by using an elongate "joining head", high-quality images with no density unevenness between overlapping areas and other areas on a print medium can be produced. Also in a serial type printing apparatus, uniform images with no seam stripes can be produced.

18 Claims, 14 Drawing Sheets

INK JET PRINTING SYSTEM AND INK JET PRINTING METHOD

BACKGROUND OF THE INVENTION

1. Field of the Invention

The present invention relates to an ink jet printing apparatus that prints images by using an elongate print head comprising a plurality of printing element substrates, each having arrays of a plurality of ink ejection printing elements. More particularly it relates to a printing method to prevent seam stripes and density unevenness caused by print areas of the plurality of printing element substrates overlapping one another. It also relates to a printing method to prevent seam stripes and density unevenness that would otherwise occur at boundaries between print areas of a plurality of print scans.

2. Description of the Related Art

Ink jet printing apparatus in general are classified largely into two types—serial type and full line type. The serial type ink jet printing apparatus forms an image by repetitively alternating a printing main scan that moves the print head in a main scan direction while ejecting ink and a sub-scan that conveyes a print medium a distance corresponding to a printing width in a direction crossing the main scan direction.

The full line type ink jet printing apparatus on the other hand uses an elongate print head the length of which corresponds to a print width of a print medium. An image is formed on the print medium by ejecting ink from the individual printing elements of the print head at a predetermined frequency while at the same time conveying the print medium in a direction crossing the direction of arrays of the printing elements at a speed corresponding to the predetermined frequency. Such a full line type printing apparatus can output an image faster than the serial type.

Since an elongate print head is constructed of a large number of ink droplet ejection printing elements arranged in line at high density, it is extremely difficult to ensure that not a single printing element will result in an ejection failure, unavoidably leading to a reduced yield in a manufacturing process. Under this circumstance, it is generally considered effective in recent years to realize an elongate print head by fabricating a number of printing element substrates which have a relative small number of printing elements and joining them together. An elongate print head of this construction is referred to as a "joining head" in this specification. The joining head, while it can be effectively used on the full line type printing apparatus, can also be applied to the serial type printing apparatus. With the joining head, the serial type printing apparatus can complete an image with fewer printing main scans, improving the printing speed.

Such a "joining head" has a problem that when a plurality of printing element substrates, each having a plurality of ejection ports arrayed therein at a predetermined pitch, are put in place, it is unavoidable that some placement errors occur among the substrates. Such substrate placement errors translate into inclinations among individual printing element substrates and variations in distance between the printing element substrates and a print medium, causing image impairments, such as black stripes and white stripes, to appear at merged portions of images formed by different scans.

To deal with this problem, Japanese Patent Laid-Open No. 2003-305853 for example discloses a method for arranging joints of printing element substrates with high precision and a method for reducing deviations in alignment pitch of ejection ports by an alignment device to physically improve manufacturing precision.

Japanese Patent Laid-Open No. H05-57965 discloses a construction in which, as shown in FIG. 13, jointing portions of printing element substrates C41-C46 (chip joints) are arranged to have an overlapping portion D made up of a predetermined number of ejection openings or ports (printing elements). With this arrangement, arrays of dots printed by the ejection ports of the overlapping portions D of two substrates are interpolated by those dots ejected from two kinds of ejection ports of other substrates, thereby distributing dot position errors, that are likely to concentrate on the jointing portion, over the entire overlapping portion.

Another method has been proposed which involves differentiating ink volumes ejected from ejection ports at the jointing portion from ink volumes of other portions, in order to make unwanted stripes, that are likely to appear at the jointing portion, less noticeable. Further, in a construction that uses a plurality of ink colors, a method has been conceived which differentiates the positions of the overlapping portions among different colors so that positional errors of the jointing portion of different colors show at different positions.

In addition to the black or white stripes caused by the placement errors of the plurality of printing element substrates, the joining head has another problem of a density unevenness that is caused by a difference in ink ejection timing between the overlapping portions and other portions.

The problem of density unevenness will be explained in detail by referring to FIG. 13. An area A on a print medium which is printed by other than the overlapping portion D of the print head takes, for completion of its printing, a length of time in which it passes a width w of one of the printing element substrates C41-C46. On the other hand, printing an area B on the print medium, which is printed by the overlapping portion D of the print head, takes a length of time in which it passes a width w' equivalent to two of the printing element substrates C41-C46. That is, the printing time of the area B is more than two times that of the area A.

In an image printed by the ink jet printing system in general, even if the same volumes of ink are used, a printed image density tends to be higher in an area applied with ink in a longer period of time than in an area applied with ink in a shorter period of time. In the example of FIG. 13, therefore, even if a uniform image is printed on a print medium P, a relatively low density area A and a relatively high density area B appear alternately, causing density unevenness. Such density unevenness does not pose any problem when only a black ink, for example, is used in producing a text image. However, when producing photographic images equivalent to silver salt pictures using such inks as light cyan and light magenta, in addition to basic four colors—cyan, magenta, yellow and black—as is increasingly performed in recent years, the density unevenness described above constitutes serious image impairments.

However, the conventional measures described above are taken to deal with black and white stripes caused by placement errors of the plurality of printing element substrates but not to deal with density variations caused by differences in printing time between overlapping portions and other portions. That is, in producing photographic images with such a high level of resolution as required in recent years at high speed by using an elongate "joining head", it is still not possible to output satisfactory images.

The similar problem may also be observed in a serial type printing apparatus that does not use the "joining head". As already explained, the serial type printing apparatus forms an image by alternating the printing main scan, which moves the print head as it ejects ink, and the sub-scan, which conveys the print medium a distance corresponding to the printing width in a direction crossing the printing main scan. Therefore, at boundaries between bands printed by individual main scans, images are printed by two main scans. As a result, these boundaries have increased densities, showing up as seam stripes.

SUMMARY OF THE INVENTION

The present invention has been accomplished with a view to overcoming the above-mentioned problems. It is therefore an object of this invention to provide an ink jet printing apparatus and a printing method that can produce high-quality images with no density unevenness between substrate-overlapping areas and other areas when photographic images are printed using an elongate "joining head". It is also an object of this invention to provide a printing method that can output a uniform image with no seam stripes also in a serial type printing apparatus.

In a first aspect of the present invention, there is provided an ink jet printing system performing a printing operation by ejecting ink to a print medium, said system comprising: a print head arranging a plurality of printing element substrates on each of which printing elements for ejecting ink are arrayed, the printing element substrates being arranged in the printing element arrayed direction so that respective printing element arrayed regions of two adjacent printing element substrates have an overlapping portion, and a signal value conversion unit to perform an image data signal value conversion so that a volume of ink applied to an image area of the print medium by printing elements of the overlapping portion of the adjacent two printing element substrates is smaller than that applied to an image area of the print medium by printing elements of printing element arrayed regions other than the overlapping portions.

In a second aspect of the present invention, there is provided an ink jet printing system performing a printing operation by ejecting ink to a print medium, said system comprising: a scanning unit which causes a printing element column arranging printing elements for ejecting ink, to scan in a scanning direction different from the printing element arrayed direction; a conveying unit which conveys the print medium along a direction crossing the scanning direction; a printing unit which performs printing on the print medium by alternately repeating a printing operation that performs printing while said scanning unit causes the printing element column to scan and a conveying operation in which the print medium is conveyed a distance smaller than a printing width of the printing element column, by said conveying unit; and a signal value conversion unit to perform an image data signal value conversion so that a volume of ink applied to overlapping areas on the print medium to be printed by two consecutive scans is smaller than that applied to other than the overlapping areas.

In a third aspect of the present invention, there is provided an ink jet printing method performing a printing operation by ejecting ink to a print medium, said method comprising the steps of: printing using a print head arranging a plurality of printing element substrates on each of which printing elements for ejecting ink are arrayed, the printing element substrates being arranged in the printing element arrayed direction so that respective printing element arrayed regions of two adjacent printing element substrates have overlapped portion; conveying the print medium relative to the print head in a direction different from the printing element arrayed direction during said printing step; and performing an image data signal value conversion so that a volume of ink applied to an image areas of the print medium to be printed by printing elements of the overlapping portions is smaller than that of an image areas of the print medium to be printed by printing elements of printing element arrayed region other than the overlapping portions.

In a fourth aspect of the present invention, there is provided an ink jet printing method performing a printing operation by ejecting ink to a print medium, said method comprising the steps of: printing by causing a printing element column arranging printing elements ejecting ink, to scan in a main scan direction different from the printing element array direction, conveying the print medium along a direction crossing the main scan direction a distance smaller than a printing width of the printing element column, following said scanning step, wherein said printing step and said conveying step are alternately repeated for performing printing to the print medium, and an image data signal value conversion is performed so that a volume of ink applied to overlapping areas on the print medium to be printed by two consecutive said scanning step is smaller than that applied to other than the overlapping areas.

Further features of the present invention will become apparent from the following description of exemplary embodiments (with reference to the attached drawings).

DESCRIPTION OF THE EMBODIMENTS

Now, embodiments applicable to the present invention will be explained in detail.

First Embodiment

Figure 1:
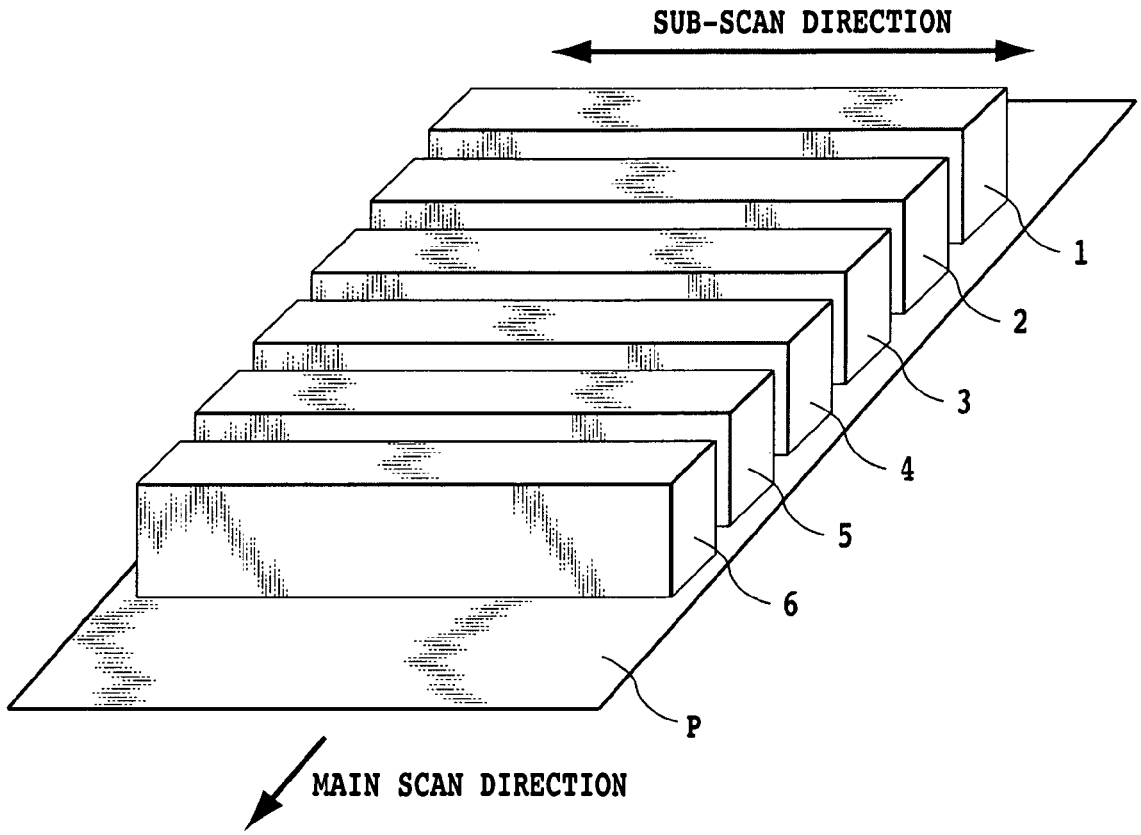
FIG. 1 is a schematic diagram showing a conceptual construction of an ink jet printing apparatus according to an embodiment of this invention.

FIG. 1 is a schematic diagram showing a conceptual construction of an ink jet printing apparatus according to this embodiment. Elongate "joining heads" 1-6 eject black (K), cyan (C), magenta (M), yellow (Y), light cyan (LC) and light magenta (LM) ink and constitute a head unit fixedly installed in the printing apparatus. The "joining heads" 1-6 are each connected with an ink supply tube not shown and with cables not shown for sending and receiving control and other signals. A print medium P, such as plain paper, high-quality dedicated paper, OHP sheet, glossy paper, glossy film and post card, is held between conveying rollers or paper discharge rollers not shown and conveyed at a constant speed in a main scan direction as a conveying motor driving. A number of printing elements, arranged in a sub-scan direction, of the "joining heads" 1-6 eject ink at a predetermined frequency in synchronism with a timing at which a linear encoder (not shown) reads the position of the print medium P and according to a print signal received through cables. With the above operation, inks are applied to the print medium P in the order of K, C, M, Y, LC and LM to form a color image.

Figure 2:
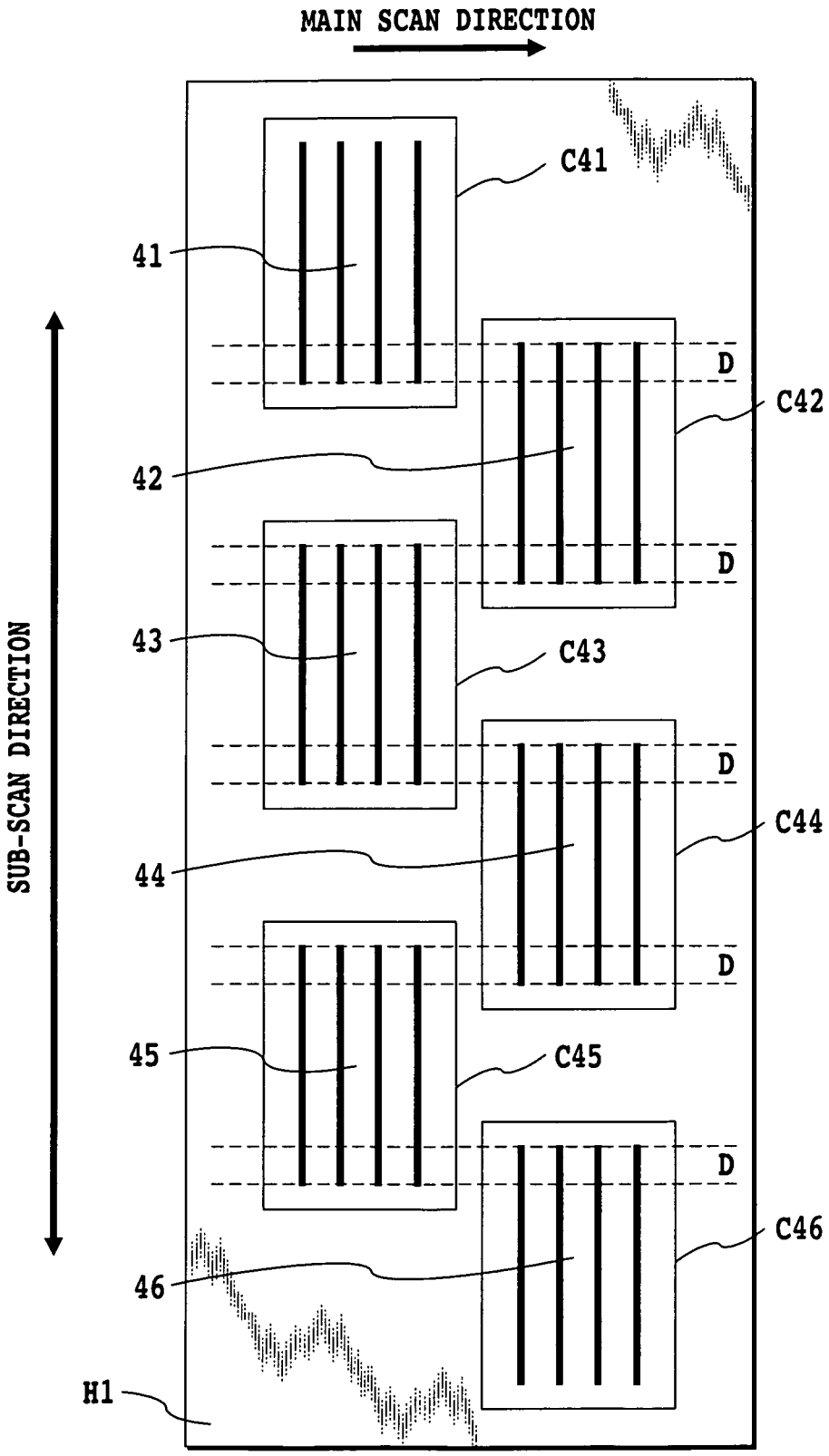
FIG. 2 is a schematic diagram showing an example of how printing element substrates or substrates making up a "joining head" for one color are arranged in the first embodiment of this invention.

FIG. 2 is a schematic diagram showing an example arrangement of printing element substrates making up a "joining head" H1 for one color according to this embodiment. Printing element substrates C41-C46 are of the same construction. Each of the substrates C41-C46 has printing element groups 41-46 each consisting of four columns of printing elements. The printing element substrates C41-C46 are arranged in two parallel columns that are laterally placed side by side in the main scan direction and extend in the sub-scan direction while at the same time the two columns are staggered in the sub-scan direction to provide each substrate with overlapping portions D. The joining head H1 with the above construction is elongate in the sub-scan direction.

Figure 3:
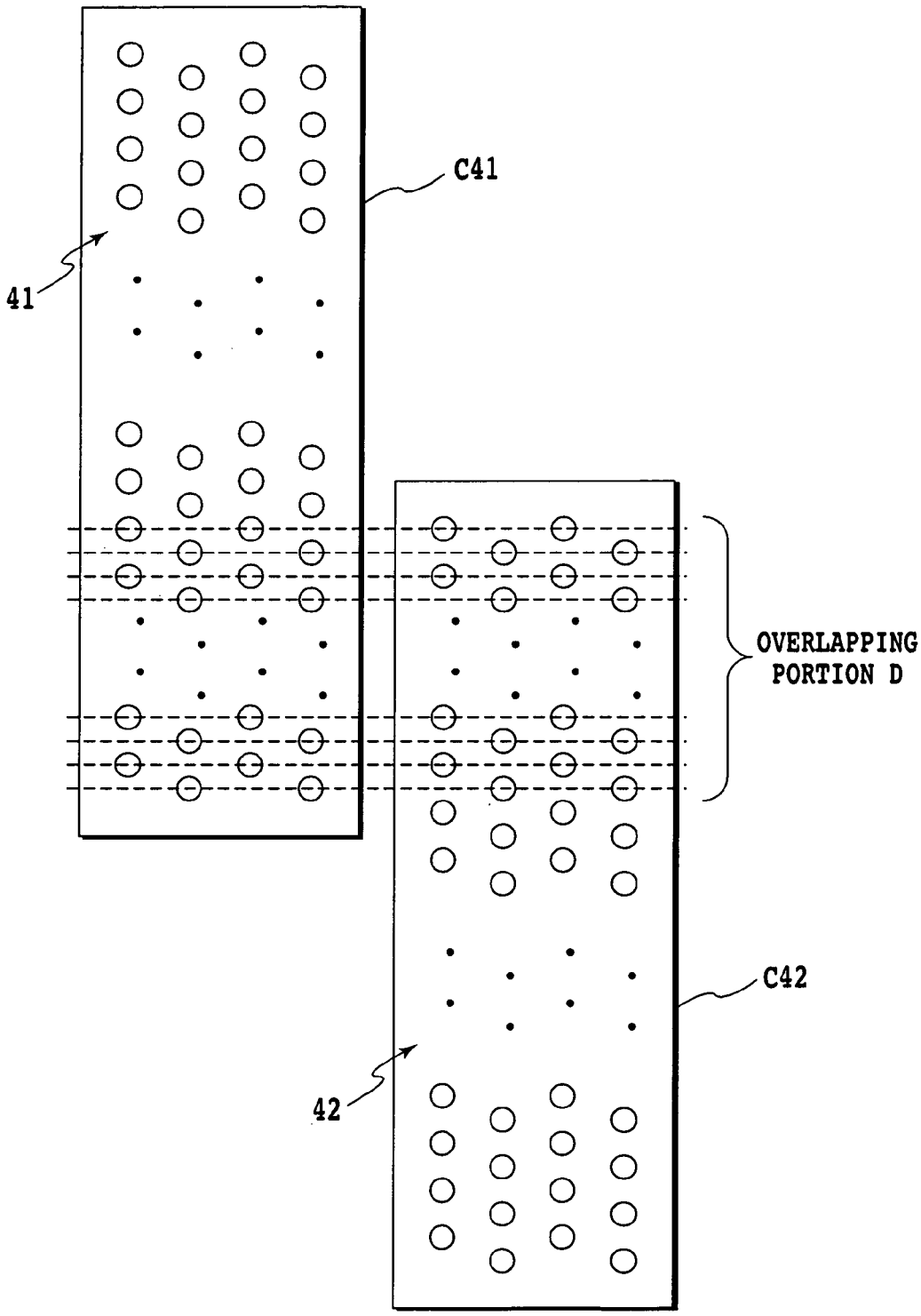
FIG. 3 is an enlarged view showing details of arrangement of the printing element substrates.

FIG. 3 is an enlarged view showing details of arrangement of the printing element substrates C41 and C42. The printing element groups 41 and 42 each have four columns of printing elements (ejection ports). Each of the ejection port columns comprises a plurality of ejection ports arrayed in the sub-scan direction at a 1,200-dpi (dots/inch) pitch. The adjacent two ejection port columns are staggered by a half pitch in the sub-scan direction so that they can print dots on a print medium at a resolution in the sub-scan direction of 2,400 dpi. The print head of this embodiment has two sets of such two columns of ejection ports, i.e., a total of four ejection port columns. With this arrangement, a row of dots running in the main scan direction can be printed by two kinds of ejection port (printing element). This can reduce ejection characteristic variations among individual printing elements by one half, ensuring an output of a smooth image.

The printing element substrate C41 and the printing element substrate C42 are arranged so that they have overlapping portions D, in which each ejection port column includes 32 ejection ports.

Figure 4:
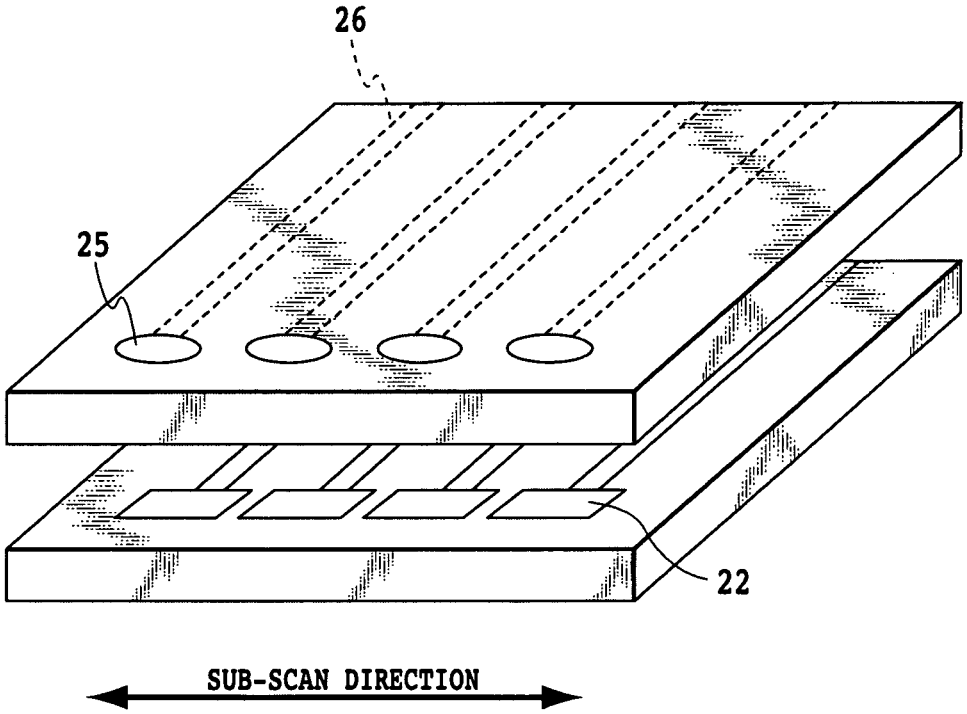
FIG. 4 is an exploded perspective view showing a construction of printing elements in a print head applicable to the embodiment of this invention.

FIG. 4 is an exploded perspective view showing the construction of printing elements in the print head of this embodiment. The printing elements of this embodiment each comprise one of ejection ports 25 arrayed in the sub-scan direction at a 1,200-dpi pitch, a heater 22 installed as an energy generation element at a position facing the associated ejection port 25, and an ink path 26 to supply ink to the ejection port. The individual ink paths 26 are connected at their rear end to a common ink chamber, which is supplied ink from an ink supply tube through an ink supply port. In response to a print signal, the heater 22 is applied an electric pulse to rapidly heat ink that is in contact with the heater, resulting in a film boiling, which in turn forms a bubble. An energy of an expanding bubble expels a predetermined volume of ink from the ejection port 25.

Figure 5:
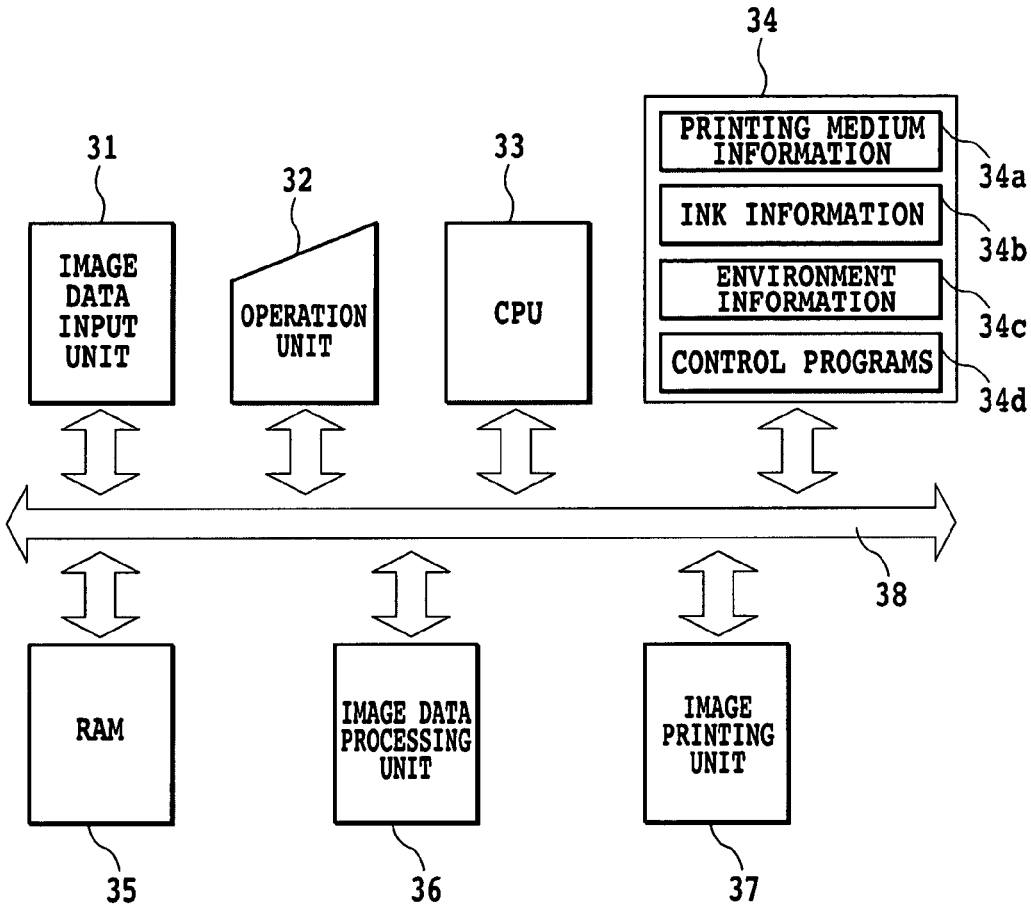
FIG. 5 is a block diagram showing a configuration of a control system in a printing system applicable to the embodiment of this invention.

FIG. 5 is a block diagram showing a configuration of a control system in the ink jet printing apparatus of this embodiment. CPU 33 controls the entire printing apparatus according to control programs 34*d* stored in a storage media 34. What is stored in the storage media 34 includes, besides the control programs 34*d*, information 34*a* about the kind of print medium, ink information 34*b*, and environment information 34*c* on temperature and humidity at time of printing. Also stored in the storage media 34 are LUTs, which are referenced when executing various image processing including color separation operation that is characteristic of this embodiment. Such a storage media 34 may use ROMs, FDs, CD-ROMs, HDs, memory cards and magneto-optical discs. A bus line 38 transmits address signals, data and control signals among functional units in the system.

An image data input unit 31 takes into the system multi-valued image data from image input devices such as scanners and digital cameras and multi-valued image data stored in hard disk drives of personal computers. An operation unit 32 has keys with which the user sets various parameters and instructs a printing start.

The CPU 33 sends image data entered from the image data input unit 31 to an image data processing unit 36 that performs various image processing on the image data according to commands received by the operation unit 32 and various information stored in the storage media 34. The image data processing unit 36 processes the multi-valued image data entered from the image data input unit 31 to generate binary print data that can be printed by the print head. The steps performed by the image data processing unit 36 will be detailed later.

The RAM 35 is used as a work area for various programs in the storage media 34, as a temporary saving area for error processing and also as a work area for image processing. The tables in the storage media 34 may be copied into the RAM 35 and their contents modified so that the image processing can be executed by referring to the modified tables.

The image printing unit 37 corresponds to the ink jet printing apparatus shown in FIG. 1. Based on the binary print data generated by the image data processing unit 36, the image printing unit 37 causes the associated ejection ports 25 to eject ink and the print medium to be conveyed, thus forming an image on the print medium.

Figure 6:
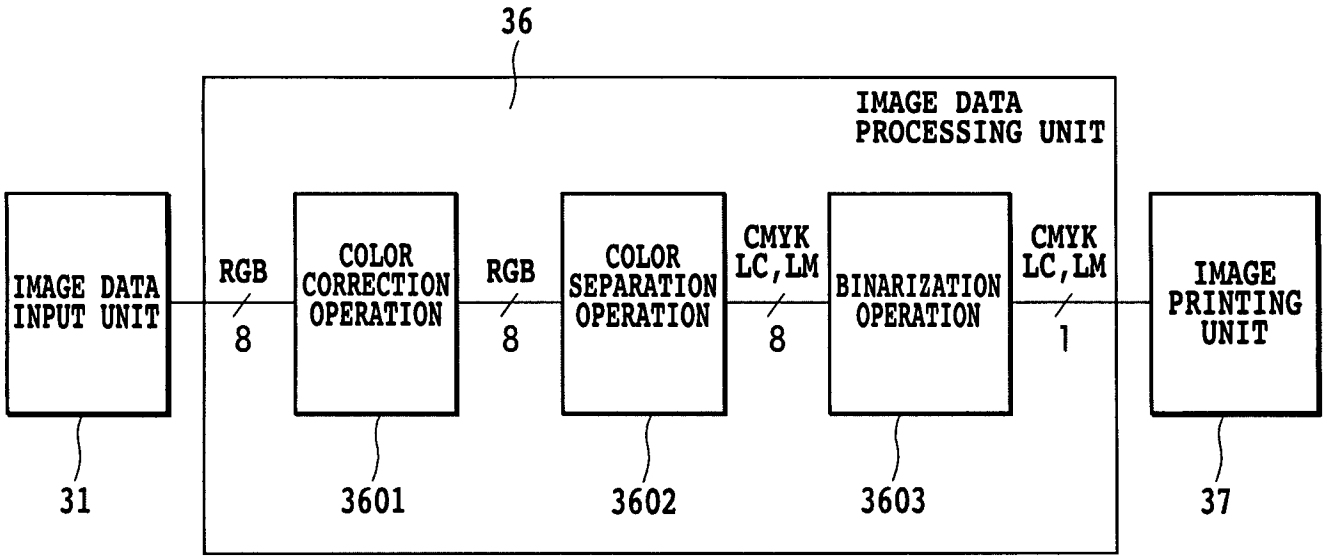
FIG. 6 is a block diagram showing details of image processing executed by an image data processing unit.

FIG. 6 is a block diagram showing details of steps of the image processing executed by the image data processing unit 36. The image data received by the image data input unit 31 is 8-bit multi-valued brightness data for red (R), green (G) and blue (B) of sRGB standard.

The image data processing unit 36 executes a color correction operation 3601 that performs data conversion to map a color space represented by the image data R, G, B of sRGB standard into a color space represented by the image printing unit 37. More specifically, the 8-bit image data R, G, B of 256 grayscale levels is converted into 8-bit R, G, B data within the color space of the image printing unit by using a three-dimensional LUT stored in the storage media 34.

In a subsequent color separation operation 3602, the 8-bit R, G, B data is converted into 8-bit grayscale data corresponding to ink colors used in the printing apparatus. More specifically, 8-bit R, G, B data is converted into 8-bit C, M, Y, K, LC, LM data by referring to a three-dimensional LUT stored in the storage media 34. This embodiment aims to solve the problem of density unevenness caused by the aforementioned overlapping portions by providing the color separation LUT with characteristics. The characteristics of the color separation operation in this embodiment will be detailed later.

The 8-bit grayscale data for six colors output from the color separation operation 3602 is converted by a subsequent binarization operation 3603 into binary density data, i.e., 1-bit data representing either a printing instruction or a non-printing instruction. Such a binarization operation may adopt a conventionally known error diffusion method or a dither method.

The binarized 1-bit data is transferred to the image printing unit 37 which, according to the 1-bit data, performs ink ejection operation using the print head.

This embodiment is characterized in that different color separation LUT's are used for the overlapping portions and the non-overlapping portions. Detailed explanations will be given as to the overlapping portions and the non-overlapping portions in this embodiment.

Figure 7:
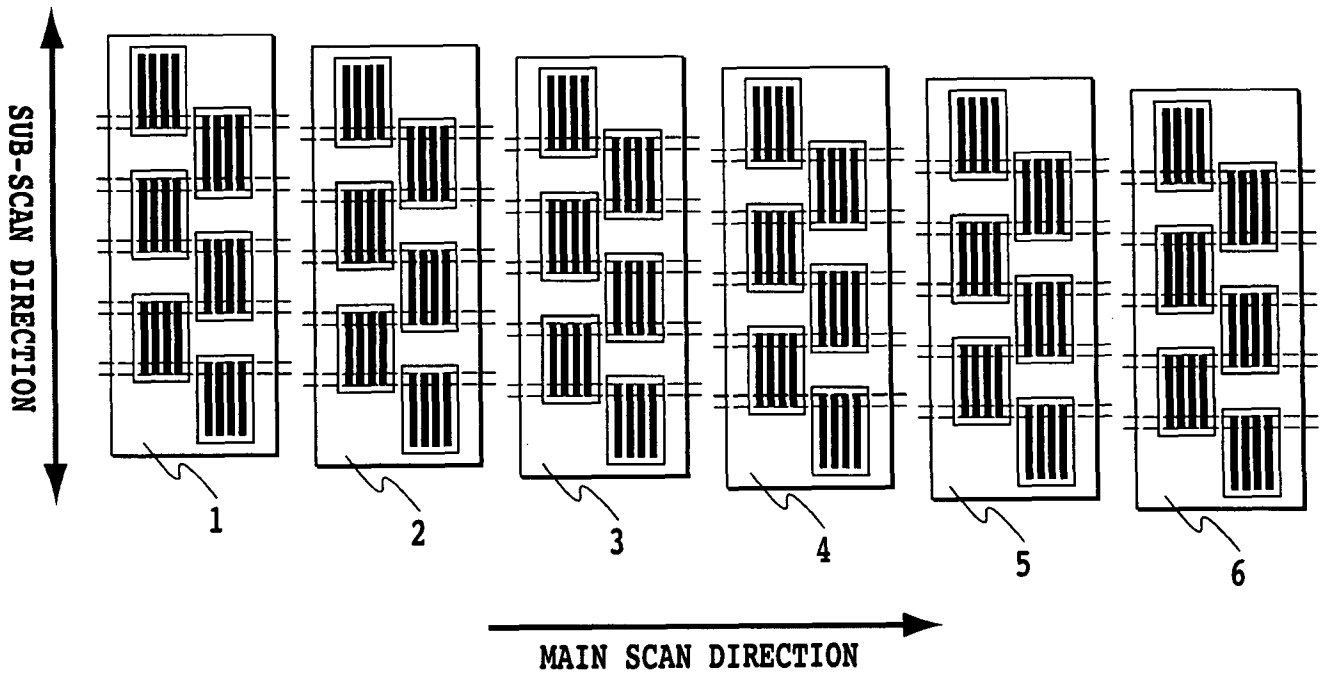
FIG. 7 is a schematic diagram showing a "joining head" and a positional relation among individual printing element substrates arranged in the joining head.

FIG. 7 is a schematic view showing "joining heads" 1-6 and a positional relation among printing element substrates mounted on these heads. The "joining heads" 1-6 of the same construction are, as explained in FIG. 1, arranged in parallel in the main scan direction but slightly staggered in the sub-scan direction. With this arrangement of the joining heads that eject different color inks, overlapping areas on a print medium printed by the overlapping portions of the substrates appear at different positions among different "joining heads".

Figure 8:
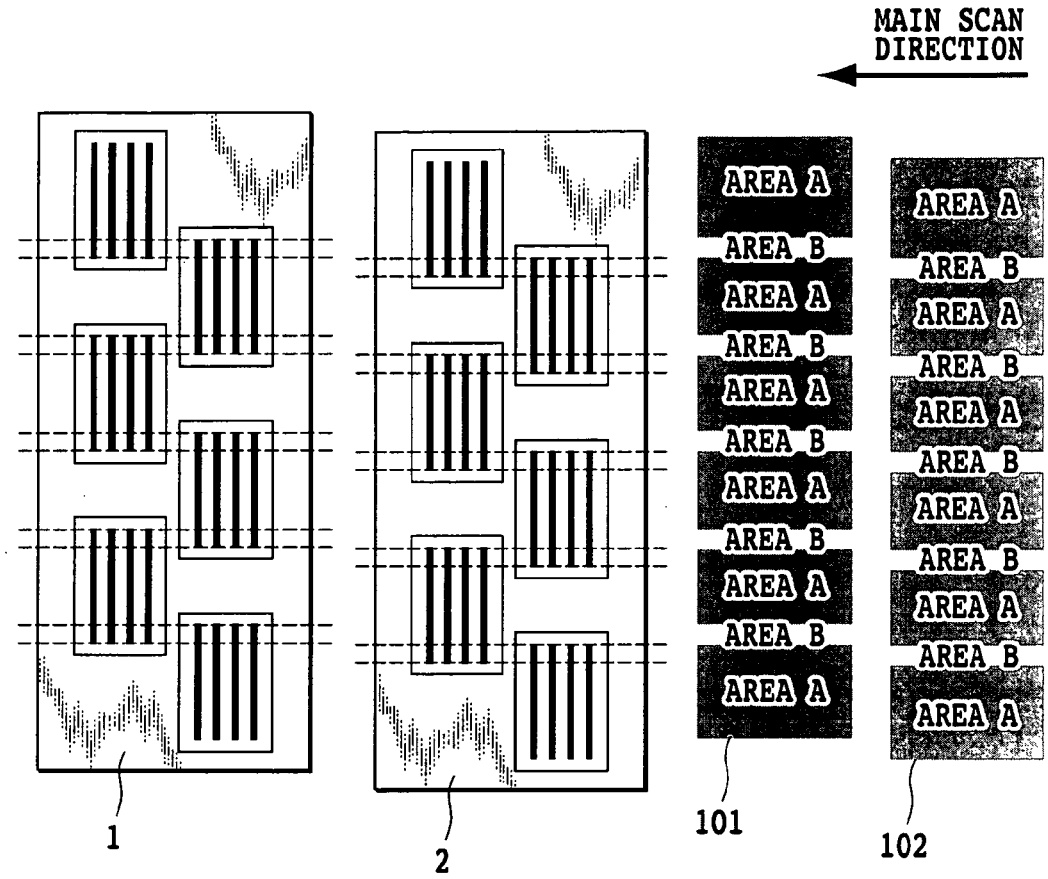
FIG. 8 is a schematic diagram showing detailed positions of overlapping areas printed on a print medium by a "joining head" of a black ink and a "joining head" of a cyan ink.
Figure 14:
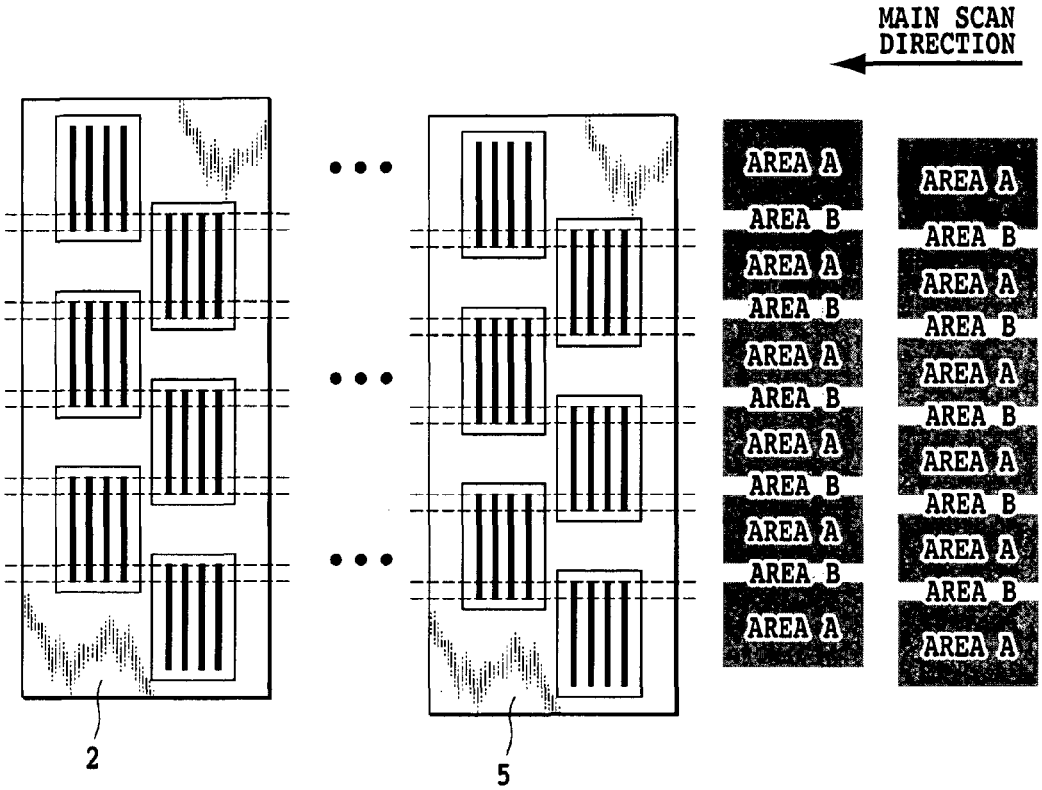
FIG. 14 is a schematic diagram showing positions of overlapping areas printed by a "joining head" of a cyan ink and a "joining head" of a light cyan ink.

FIG. 8 shows in detail positions of overlapping areas on a print medium corresponding to a "joining head" 1 that ejects a black ink and a "joining head" 2 that ejects a cyan ink. Reference number 101 represents a print area on a print medium printed by the "joining head" 1 and 102 a print area on the print medium printed by the "joining head" 2. FIG. 14 shows in detail positions of overlapping areas on a print medium corresponding to a "joining head" 2 that ejects a cyan ink and a "joining head" 5 that ejects a light cyan ink. In these figures, areas A represent image areas printed by ejection ports formed in other than the overlapping portions of the head and areas B represent overlapping areas printed by ejection ports formed in the overlapping portions. It is seen that the positions in the sub-scan direction of the areas B vary from one "joining head" to another. Although the relationship between the "joining heads" 1 and 2 or between "joining heads" 2 and 5 is shown here, the positions in the sub-scan direction of the areas B differ among all the different "joining heads" 1-6. In this embodiment, the width of the overlapping portions in each "joining head" and the amount of shift in the sub-scan direction between the individual "joining heads" are determined to prevent the overlapping areas of different colors on a print medium from overlapping one another.

Figure 9:
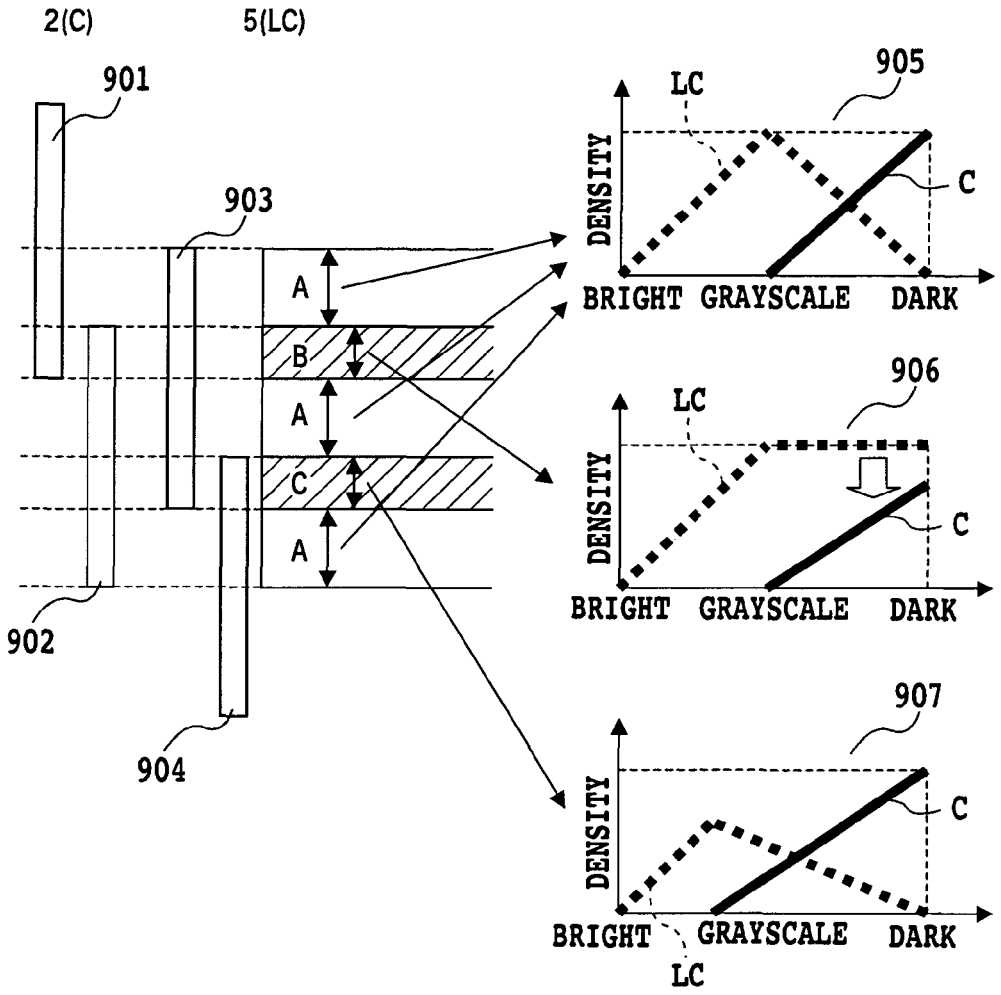
FIG. 9 is a schematic diagram showing color separation operation performed for overlapping areas and for non-overlapping areas.

FIG. 9 shows the color separation operations performed for overlapping areas and non-overlapping areas. Here, for the sake of simplicity, let us explain the color separation operation for "joining heads" 2 and 5 that eject similar color inks—a cyan ink (first ink, C) and a light cyan ink (second ink, LC)—respectively. In the figure, reference numbers 901 and 902 represent positions in the sub-scan direction of a first printing element group and a second printing element group in the "joining head" 2. Reference numbers 903 and 904 represent positions in the sub-scan direction of a first printing element group and a second printing element group in the "joining head" 5, relative to the positions of 901 and 902. In such an arrangement, the areas A on a print medium represent non-overlapping areas printed by the non-overlapping portions of the print head 2 and the print head 5. The area B represents an area printed by the overlapping portions of the print head 2 and by the non-overlapping portions of the print head 5. Further, the area C represents an area printed by the non-overlapping portions of the print head 2 and by the overlapping portions of the print head 5.

As explained in the Description of Related Art, the overlapping areas printed by the overlapping portions of the head take longer to print than the areas printed by the non-overlapping portions and thus are likely to have an increased image density. Therefore the areas B tend to be higher in cyan density than the areas A, and the areas C tend to be higher in light cyan density than the areas A. So, in this embodiment, even if the same grayscale cyan densities are to be realized, the amount of cyan ink to be applied to the areas B is made smaller than that for the areas A. Likewise, as for the light cyan ink, the amount of light cyan ink to be applied to the areas C is made smaller than that for areas A. For this purpose, independent color separation tables (LUT's) are prepared for areas A, B, C.

Denoted 905-907 are diagrams showing how the color separation operation is performed for each of the areas A, B, C. An abscissa represents grayscale values of cyan data, and an ordinate represents output signal values for cyan and light cyan corresponding to the grayscale value. The output value can be said to be equivalent to the number of ink droplets or the volume of ink to be applied to a unit area of print medium. The color separation operation 905 for the area A outputs only light cyan signal with highlight to half-tone values while keeping the cyan output at zero. Once the output value of light cyan reaches maximum, the cyan output value is progressively increased while at the same time the light cyan output value is gradually decreased. When the grayscale value reaches its maximum, the cyan output is maximum and light cyan output is zero.

In contrast to this, the color separation operation 906 for the area B does not reduce the light cyan output even in a grayscale range following the light cyan output having reached its maximum. Although the cyan output is progressively increased, its inclination or rate of rise is smaller than that of the area A so that even when the grayscale level reaches its maximum, the cyan output is not maximum. In the area B since the cyan ink density tends to be higher than that of the area A, the cyan output is restricted and the amount the density falls short of what is needed is made up for by the appropriate application of light cyan ink.

In the color separation operation 907 for the area C, the cyan ink output is progressively increased in a grayscale range, starting before the light cyan output becomes maximum, and at the same time the light cyan output is reduced gradually. When the grayscale level reaches its maximum, the cyan output is maximum and the light cyan output is zero. In the area C since the light cyan ink density tends to be higher than that of the area A, the light cyan output is restricted and the amount the density falls short of what is needed is made up for by the appropriate application of cyan ink.

Figure 10:
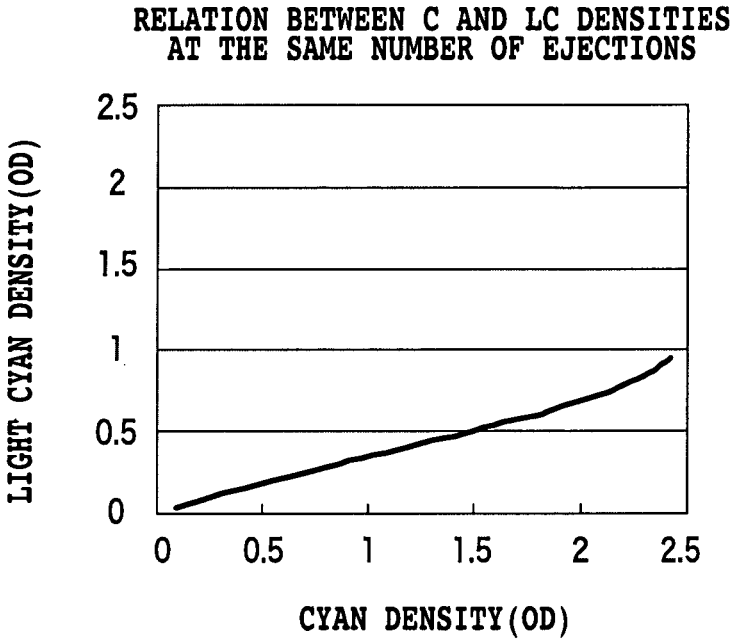
FIG. 10 is a graph showing a density difference on a print medium between a cyan ink and a light cyan ink.

FIG. 10 is a graph showing a density difference on a print medium between a cyan ink and a light cyan ink used in this embodiment. Here, an abscissa represents an image density of cyan ink and an ordinate represents an image density of light cyan ink. The figure shows that if an optical density of, for example, 0.5 is to be expressed, the use of light cyan ink requires applying the same number of ink droplets as the number of cyan ink droplets that can realize an optical density of 1.5. To implement this embodiment, it is effective to examine in advance the relation between the density and the number of droplets of cyan and light cyan, such as shown in FIG. 10. In any of the color separation operations 905-907 explained with reference to FIG. 9, output values for individual grayscale levels need only be adjusted so that equal optical densities can be obtained at all times for all grayscale levels.

In this case, if the cyan density in the area B can be matched to that of the area A by only reducing the cyan signal value, there is no need to differentiate the light cyan output value from that of the area A. Similarly, if the cyan density in the area C can be matched to that of the area A by only reducing the light cyan signal value, there is no need to differentiate the cyan output value from that of the area A.

While we have explained the example relation between cyan and light cyan, this embodiment prepares independent color conversion tables in the similar manner also for magenta and light magenta as the first and second ink. For other ink colors, it is of course possible to execute a signal value conversion that suppresses the ink volume to be applied to the substrate-overlapping areas on a print medium.

To verify the effects of this embodiment, an example of verification tests conducted by the inventors of this invention will be explained below. The inventors of this invention used a full line type ink jet printing apparatus and "joining heads" explained with reference to FIG. 1 to FIG. 7. As inks for the test, ink BCI-7 (K, C, M, Y, LC, LM) for an ink jet printer PIXUS IP7100 (of Canon inc. make) were used. As print medium, glossy paper (pro-photo paper PR-101 (Canon inc. make)) dedicated for ink jet printing was used. The print head was driven at an ejection frequency of 8 kHz to form grayscale patches with 100%, 75%, 50% and 25% duties with a resolution of 2,400 dpi both in the main scan direction and in the sub-scan direction and also print a photographic image. At this time, for cyan, light cyan, magenta and light magenta, three kinds of color separation tables for overlapping areas and non-overlapping areas were prepared for the color separation operation explained with reference to FIG. 9. An image was printed according to these color conversion tables (LUT's).

In a test for comparison with the above verification test, one kind of color conversion table for execution of the operation 905 of FIG. 9 was prepared for cyan, light cyan, magenta and light magenta, regardless of whether the area concerned is a overlapping area. With other conditions set equal to those of the above verification test, the same image as that of the verification test was printed.

As a result, in an image produced in the comparison test, seam stripes corresponding to substrate joints and density unevenness were observed. On the other hand, in the verification test a uniform, high-quality image without seam stripes or density unevenness could be obtained.

Second Embodiment

While the first embodiment has been shown to be effective in the full line type printing apparatus, this invention can also be applied to a serial type printing apparatus that does not use "joining heads".

Figure 11:
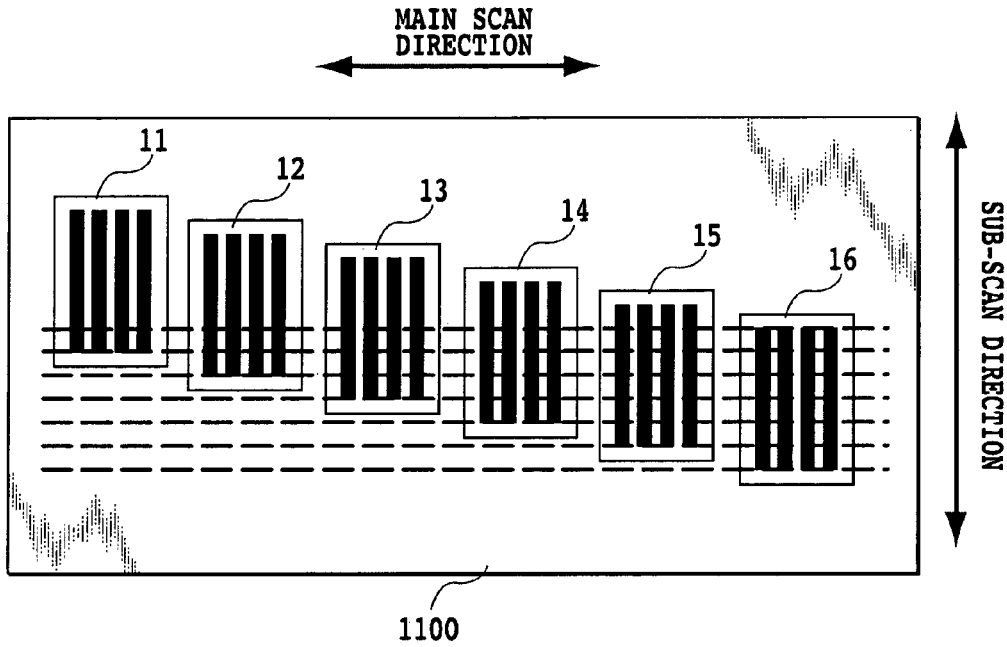
FIG. 11 is a schematic diagram showing a print head of a second embodiment that can be mounted in a serial type printing apparatus.

FIG. 11 is a schematic view showing a print head of this embodiment that can be mounted in a serial type printing apparatus. The print heads 11-16 have the same construction and are arranged slightly staggered in the sub-scan direction. With this arrangement of the print heads 11-16 that eject different color inks, seam stripes between individual printing scans are formed at different positions for different ink colors. The print heads 11-16 are integrally constructed in a positional relation shown in the figure to form a print head cartridge 1100.

Figure 12:
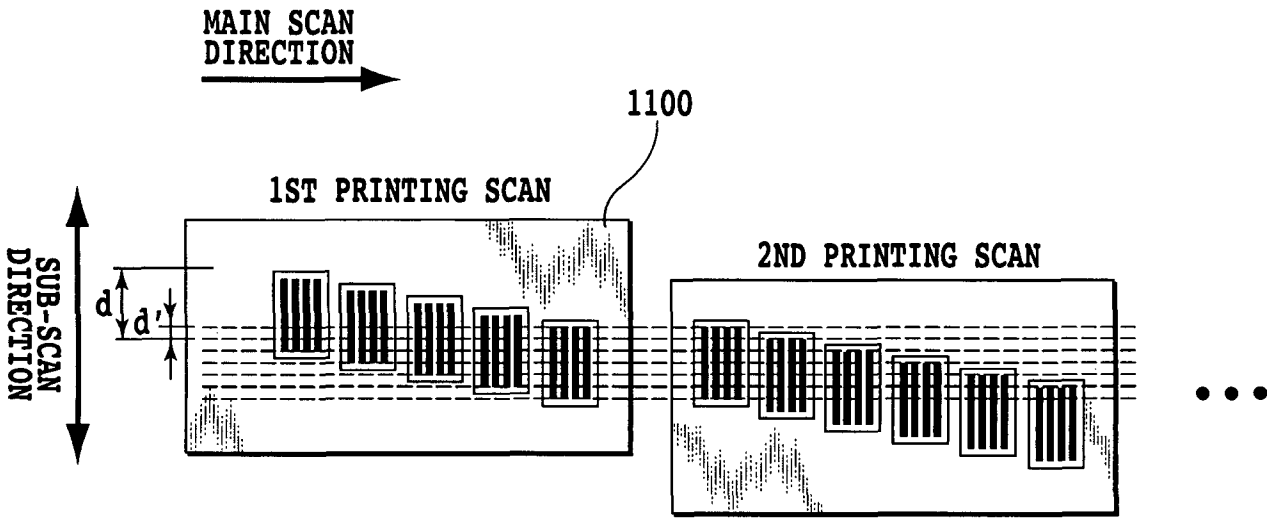
FIG. 12 is a schematic diagram showing how a print head cartridge performs printing scans over a print medium.
Figure 13:
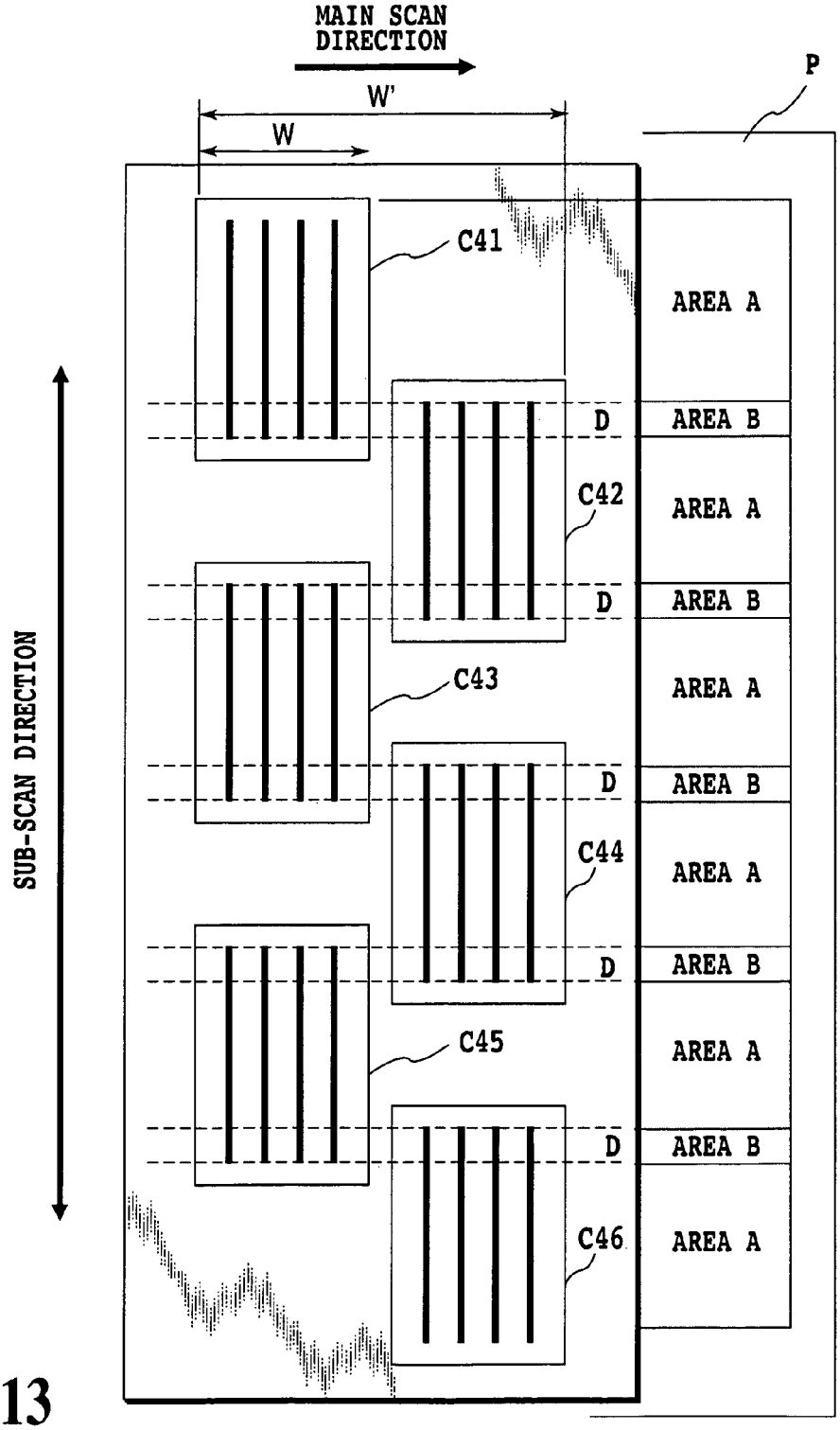
FIG. 13 is a schematic diagram showing a print head so constructed that the printing element substrates each have overlapping portions D at substrate joints.

FIG. 12 is a schematic diagram showing how the print head cartridge 1100 is scanned over a print medium for printing. The serial type printing apparatus forms an image on a print medium by repeating the printing scan in the main scan direction a plurality of time, with a paper conveying operation executed between the printing main scans to convey the print medium in the sub-scan direction. The distance the print medium is conveyed during the paper conveying operation is generally matched to a printing width d of individual print heads. In this embodiment, the paper feed distance is adjusted to d-d' so as to provide a predetermined overlapping portion d' to avoid unwanted black and white stripes that would be formed by variations in paper conveying distance. This embodiment determines the amount that the individual print heads are shifted from each other in the sub-scan direction and the paper conveying distance so that the positions of the overlapping portions d' of different color print heads do not overlap in the sub-scan direction.

In the serial type printing apparatus used in this embodiment, an image in those areas on a print medium that are printed by the non-overlapping portions of the heads is completed by one printing scan, whereas overlapping areas on the print medium printed by the overlapping portions d' of the heads are applied ink in two printing scans. Thus, the overlapping areas on the print medium printed by the overlapping portions d' tend to be higher in image density than the non-overlapping areas printed by the non-overlapping portions. Therefore, even if the same grayscale levels are to be expressed, this embodiment prepares a color conversion table (LUT) for the color separation operation that reduces the volume of ink to be ejected from the overlapping portions d' of the heads.

With the above construction, this embodiment can produce a uniform image with no seam stripes in overlapping areas or density unevenness on a print medium even if printing is done by a serial type printing apparatus.

Although in the second embodiment the present invention has been described to be applied to a serial type printing apparatus using print heads other than the "joining heads", the "joining head" construction can of course be adopted advantageously also with the serial type printing apparatus. In that case, in addition to the color conversion tables that take into consideration the densities of overlapping areas characteristic of the "joining heads", a color conversion table that considers densities of overlapping areas at boundaries between printing scans may also be prepared. This can realize both of the effects of the first embodiment and the second embodiment at the same time.

In the above, we have described, as examples of the invention, ink jet printing apparatus that use a set of two inks of the same color with different densities, such as a set of cyan and light cyan and a set of magenta and light magenta. It is noted, however, that the present invention is not limited to this construction. This invention can also be applied to a printing apparatus that uses a plurality of inks of the same color with three or more different densities.

In the above embodiments, printing elements have been described to have a heater as an energy generation element. This invention is not limited to this construction. In the case of an on-demand type that ejects ink droplets as necessary, as with the above embodiments, it is possible to adopt a pressure control system that causes ink droplets to be ejected from orifices by mechanical vibrations of piezoelectric elements. In the case of a continuous type that continuously ejects ink droplets, a charge control configuration or a scatter control configuration may be employed.

In the above embodiments, as shown in FIG. 5, a series of processes, from the processing of image data entered from the image data input unit 31 to the printing of the image data processed by the image printing unit 37, is performed by one system having a plurality of functional units. This invention may also be configured such that all different functional devices are installed in the same printing apparatus.

Further, to operate various devices to implement the aforementioned functions of the embodiments, software program codes for implementing these functions may be supplied to a computer in an apparatus or system connected to the devices. In that case, the software program codes themselves implement the aforementioned embodiments, and therefore the software program codes and a means of supplying the program codes to the computer, such as a storage media holding the program codes, constitute the present invention. Storage media to store such program codes include, for example, floppy (registered trademark) disks, hard disks, optical discs, magneto-optical discs, CD-ROMs, magnetic tapes, non-volatile memories and ROMs. Not only are the aforementioned functions of the embodiments implemented by the computer executing the loaded program codes, but the above embodiments may also be implemented by the cooperation between the program codes and an operating system (OS) and application software running on the computer. In such a case, the program codes constitute an embodiment of this invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-178668, filed Jul. 6, 2007, which is hereby incorporated by reference herein in its entirety.

What is claimed is:

1. An ink jet printing apparatus for printing an image on a print medium by using a first print head ejecting a first ink and a second print head ejecting a second ink, wherein in the first print head are arranged a first printing element group and a second printing element group, in each of which a plurality of printing elements are arranged in a predetermined direction, so as to form an overlapping region and a non-overlapping region in the predetermined direction, the overlapping region corresponding to an area of the print medium printed by both of the first printing element group and the second printing element group and the non-overlapping region corresponding to an area of the print medium printed by either the first printing element group or the second printing element group, the ink jet printing apparatus comprising:

an ink amount setting unit configured to set amounts of the first ink and the second ink applied to a unit area on the print medium based on image data so that an amount of the first ink applied to the unit area by the overlapping region is less than an amount of the first ink applied to the unit area by the non-overlapping region and an amount of the second ink applied to the unit area that is printed by the overlapping region of the first print head is not less than an amount of the second ink applied to the unit area that is printed by the non-overlapping region of the first print head; and a control unit to control ejection of the first ink from the first print head and the second ink from the second print head according to the amounts set by the ink amount setting unit.

2. The ink jet printing apparatus according to claim 1, wherein the first printing element group is arranged so as to be shifted from the second printing element group in the predetermined direction.

3. The ink jet printing apparatus according to claim 1, wherein the ink amount setting unit sets the amounts of the first ink and the second ink applied to the unit area on the print medium so that the amount of the second ink applied to the unit area that is printed by the overlapping region of the first print head is more than the amount of the second ink applied to the unit area that is printed by the non-overlapping region of the first print head.

4. The ink jet printing apparatus according to claim 3, wherein the first ink and the second ink are of different densities.

5. The ink jet printing apparatus according to claim 1, wherein in the second print head are arranged a third printing element group and a fourth printing element group, in each of which a plurality of printing elements are arranged in the predetermined direction, so as to form an overlapping region and a non-overlapping region in the predetermined direction, the overlapping region corresponding to an area of the print medium printed by both of the third printing element group and the fourth printing element group and the non-overlapping region corresponding to an area of the print medium printed by either the third printing element group or the fourth printing element group.

6. The ink jet printing apparatus according to claim 5, wherein the overlapping region of the first print head is positioned corresponding to the non-overlapping region of the second print head in the predetermined direction.

7. The ink jet printing apparatus according to claim 6, wherein the ink amount setting unit sets the amounts of the first ink and the second ink so that the amount of the second ink applied to the unit area by the overlapping region is less than the amount of the second ink applied to the unit area by the non-overlapping region and the amount of the first ink applied to the unit area that is printed by the overlapping region of the second print head is not less than the amount of the first ink applied to the unit area that is printed by the non-overlapping region of the second print head.

8. An ink jet printing method for printing an image on a print medium by using a first print head ejecting a first ink and a second print head ejecting a second ink, wherein in the first print head are arranged a first printing element group and a second printing element group, in each of which a plurality of printing elements are arranged in a predetermined direction, so as to form an overlapping region and a non-overlapping region in the predetermined direction, the overlapping region corresponding to an area of the print medium printed by both of the first printing element group and the second printing element group and the non-overlapping region corresponding to an area of the print medium printed by either the first printing element group or the second printing element group, the ink jet printing method comprising:

an ink amount setting step to set amounts of the first ink and the second ink applied to a unit area on the print medium based on image data so that an amount of the first ink applied to the unit area by the overlapping region is less than an amount of the first ink applied to the unit area by the non-overlapping region and an amount of the second ink applied to the unit area that is printed by the overlapping region of the first print head is not less than an amount of the second ink applied to the unit area that is printed by the non-overlapping region of the first print head; and a controlling step to control ejection of the first ink from the first print head and the second ink from the second print head according to the amounts set in the ink amount setting step.

9. The ink jet printing method according to claim 8, wherein the first printing element group is arranged so as to be shifted from the second printing element group in the predetermined direction.

10. The ink jet printing method according to claim 8, wherein the ink amount setting step sets the amounts of the first ink and the second ink applied to the unit area on the print medium so that the amount of the second ink applied to the unit area that is printed by the overlapping region of the first print head is more than the amount of the second ink applied to the unit area that is printed by the non-overlapping region of the first print head.

11. The ink jet printing method according to claim 10, wherein the first ink and the second ink are of different densities.

12. The ink jet printing method according to claim 8, wherein in the second print head are arranged a third printing element group and a fourth printing element group, in each of which a plurality of printing elements are arranged in the predetermined direction, so as to form an overlapping region and a non-overlapping region in the predetermined direction, the overlapping region corresponding to an area of the print medium printed by both of the third printing element group and the fourth printing element group and the non-overlapping region corresponding to an area of the print medium printed by either the third printing element group or the fourth printing element group.

13. The ink jet printing method according to claim 12, wherein the overlapping region of the first print head is positioned corresponding to the non-overlapping region of the second print head in the predetermined direction.

14. The ink jet printing method according to claim 13, wherein the ink amount setting step sets the amounts of the first ink and the second ink so that the amount of the second ink applied to the unit area by the overlapping region is less than the amount of the second ink applied to the unit area by the non-overlapping region and the amount of the first ink applied to the unit area that is printed by the overlapping region of the second print head is not less than the amount of the first ink applied to the unit area that is printed by the non-overlapping region of the second print head.

15. A data processing apparatus for printing an image on a print medium by using a first print head ejecting a first ink and a second print head ejecting a second ink, wherein in the first print head are arranged a first printing element group and a second printing element group, in each of which a plurality of printing elements are arranged in a predetermined direction, so as to form an overlapping region and a non-overlapping region in the predetermined direction, the overlapping region corresponding to an area of the print medium printed by both of the first printing element group and the second printing element group and the non-overlapping region corresponding to an area of the print medium printed by either the first printing element group or the second printing element group, the data processing apparatus comprising:

an ink amount setting unit configured to set amounts of the first ink and the second ink applied to a unit area on the print medium based on image data so that an amount of the first ink applied to the unit area by the overlapping region is less than an amount of the first ink applied to the unit area by the non-overlapping region and an amount of the second ink applied to the unit area that is printed by the overlapping region of the first print head is not less than an amount of the second ink applied to the unit area that is printed by the non-overlapping region of the first print head; and a control unit to control ejection of the first ink from the first print head and the second ink from the second print head according to the amounts set by the ink amount setting unit.

16. The data processing apparatus according to claim 15, wherein in the second print head are arranged a third printing element group and a fourth printing element group, in each of which a plurality of printing elements are arranged in the predetermined direction, so as to form an overlapping region and a non-overlapping region in the predetermined direction, the overlapping region corresponding to an area of the print medium printed by both of the third printing element group and the fourth printing element group and the non-overlapping region corresponding to an area of the print medium printed by either the third printing element group or the fourth printing element group, and the overlapping region of the first print head is positioned corresponding to the non-overlapping region of the second print head in the predetermined direction, and wherein the ink amount setting unit sets the amounts of the first ink and the second ink so that the amount of the second ink applied to the unit area by the overlapping region is less than the amount of the second ink applied to the unit area by the non-overlapping region and the amount of the first ink applied to the unit area that is printed by the overlapping region of the second print head is not less than the amount of the first ink applied to the unit area that is printed by the non-overlapping region of the second print head.

17. The data processing apparatus according to claim 15, wherein the ink amount setting unit sets the amounts of the first ink and the second ink applied to the unit area on the print medium so that the amount of the second ink applied to the unit area that is printed by the overlapping region of the first print head is more than the amount of the second ink applied to the unit area that is printed by the non-overlapping region of the first print head.

18. The data processing apparatus according to claim 17, wherein the first ink and the second ink are of different densities.

* * * * *